United States Patent [19]

Ito et al.

[11] Patent Number: 4,849,789

[45] Date of Patent: Jul. 18, 1989

[54] IMAGE DUPLICATING APPARATUS FOR MULTIPLE IMAGES WITH MAGNIFICATION OR REDUCTION ALTERATION DURING DUPLICATION

[75] Inventors: Masazumi Ito; Kimihiko Higashio, both of Aichi, Japan

[73] Assignee: Minolta Camera Kabushiki Kaisha, Osaka, Japan

[21] Appl. No.: 123,043

[22] Filed: Nov. 19, 1987

[30] Foreign Application Priority Data

Jul. 3, 1987 [JP] Japan ..... 62-167569

[51] Int. Cl.[4] ..... G03G 15/00

[52] U.S. Cl. ..... 355/243; 355/55; 355/218

[58] Field of Search ..... 355/8, 14 R, 55–57

[56] References Cited

U.S. PATENT DOCUMENTS

| | | | |
|---|---|---|---|
| 4,017,173 | 4/1977 | Komori et al. | 355/8 |
| 4,437,756 | 3/1984 | Kawakubo et al. | 355/14 R |
| 4,639,120 | 1/1987 | Matsuura | 355/14 R |

OTHER PUBLICATIONS

*IBM Technical Disclosure Bulletin,* vol. 18, No. 10, Mar. 1976, pp. 3162 to 3163, Miller, M. J., "Program Control of Job Control Information Entry for Copier".

*Primary Examiner*—Arthur T. Grimley
*Assistant Examiner*—J. Pendergrass
*Attorney, Agent, or Firm*—Price, Gess & Ubell

[57] ABSTRACT

An image duplicating apparatus having a document table for supporting a document sheet thereon divides an image area of the document into two sections and successively duplicates the respective images of the two sections onto two separate copy surfaces. Switches specify the ratio by which an image on the document sheet is to be magnified or reduced for. An image magnification/reduction lens unit responds to the switches for altering a currently established magnification or reduction ratio to the newly specified ratio of magnification or reduction. A control circuit controls the duplicating means so that, when the magnification or reduction ratio is altered prior to termination of the duplication of a first one of the two sections, a second one of the two sections is copied in the altered magnification or reduction ratio.

5 Claims, 13 Drawing Sheets

B2
B19
TIM'G SIGNAL = 1
NO
YES
B20
ACTIVATE TIM'G ROLLER CLUTCH & START TIMER 'TC'
B21
TIMER 'TC' OUT
NO
YES
B22
DEACTIVE CHAGER 42 & TIM'G ROLLER CLUTCH; STOP SCANNING
B23
RETURN SIGNAL=1
NO
YES
B24
MULTI-COPY'G OVER
NO
YES
B25
DIV. COPY'G MODE SELECTED
YES
B3
B26-B31 (FIG. 5D)
B34
STATA FLAG ← 1
NO
B32
HOME POS'N SIGNAL=1
B4
NO
B33
YES
STOP MOTOR 45 DEACTIVE TRANSFER CHARGER 46 START TIMER 'TD'
B5

SCAN CONTROL SUBROUTINE

IMAGE DUPLICATING APPARATUS FOR MULTIPLE IMAGES WITH MAGNIFICATION OR REDUCTION ALTERATION DURING DUPLICATION

FIELD OF THE INVENTION

The present invention relates to an image duplicating apparatus and, more particularly, to an image duplicating apparatus which has a book copying mode of operation by which a document sheet consisting of opposite two pages spread out of a book or of any other form of bound volume of image-bearing pages can be copied on separate copy surfaces Such a mode of copying operation is herein referred to as halved or divisional copying mode.

BACKGROUND OF THE INVENTION

An image duplicating apparatus of the type having a divisional copying mode of operation is per se known from, for example, Japanese Provisional Patent Publication (Kokai) No. 60-221,770. In the apparatus disclosed in this prior-art Publication, opposite two pages spread out of a book placed on the document table can be respectively duplicated on separate copy sheets without moving the book on the table after one of the pages has been copied.

A duplicating apparatus of this type can be used not merely for the copying of such spread two pages of a book or of any other form of bound volume of image-bearing pages but also for the copying of two separate document sheets by a single copying operation. For this purpose, the duplicating apparatus is first conditioned to be capable of performing the halve document copying mode of operation with the two separate document sheets juxtaposed on the document table of the apparatus. The two documents sheets thus placed on the document table are optically scanned and respectively duplicated on separate copy sheets one after the other simply with the print-start switch of the apparatus depressed by a single touch. Such an apparatus is useful and will provide an increased copying efficiency in that only a single manipulative effort suffices for the copying of two opposite pages of a book or two separate document sheets which would otherwise require two repeated manipulative efforts.

During use of such a duplicating apparatus, it is frequently desired that the copying conditions once selected for one of the two document sheets or pages be altered for the copying of the other. Exacting restrictions have however been encountered to meet such a demand although the density of print for copying can be by any means changed between the two document sheets or pages. For this reason, the capability of the apparatus for the divisional copying mode could not be exploited where it is desired that different copying conditions be used for the duplication of two document sheets or pages in the divisional copying mode.

Thus, a known image duplicating apparatus having the divisional copying mode has had a drawback in that the copying conditions once selected for one of two juxtaposed document sheets or pages can not be altered for the copying of the other. Where it is desired that the two document sheets or pages be copied in different conditions or with different operational parameters, the operator is compelled to repeat two manipulative procedures for copying the two separate document sheets or pages in the ordinary copying mode of operation.

This not only wastes the potential capability of the apparatus but limits the performance efficiency inherently achievable by the apparatus.

It is, accordingly an important object of the present invention to provide an improved image duplicating apparatus having a divisional copying mode of operation in which the ratio of magnification or reduction of copying once selected for one of two document sheets or pages juxtaposed on the document table of the apparatus can be altered for the copying of the other.

SUMMARY OF THE INVENTION

In accordance with one outstanding aspect of the present invention, there is provided an image duplicating apparatus which comprises (a) means for supporting a document sheet thereon, (b) means for dividing an image area of said document sheet into two sections and successively duplicating the respective images on the two sections onto two separate copy surfaces, respectively, (c) means for specifying the ratio by which an image on the document sheet is to be magnified or reduced for copying, (d) means for altering a currently established magnification or reduction ratio to the specified ratio of magnification or reduction, and (e) control means for controlling the duplicating means so that, when the magnification or reduction ratio is altered prior to termination of the duplication of a first one of the two sections, a second one of the two sections is copied in the altered magnification or reduction ratio.

BRIEF DESCRIPTION OF THE DRAWINGS

The features and advantages of an automated image duplicating apparatus according to the present invention will be more clearly appreciated from the following description taken in conjunction with the accompanying drawings in which.

DESCRIPTION OF THE PREFERRED EMBODIMENTS

Figure 1:
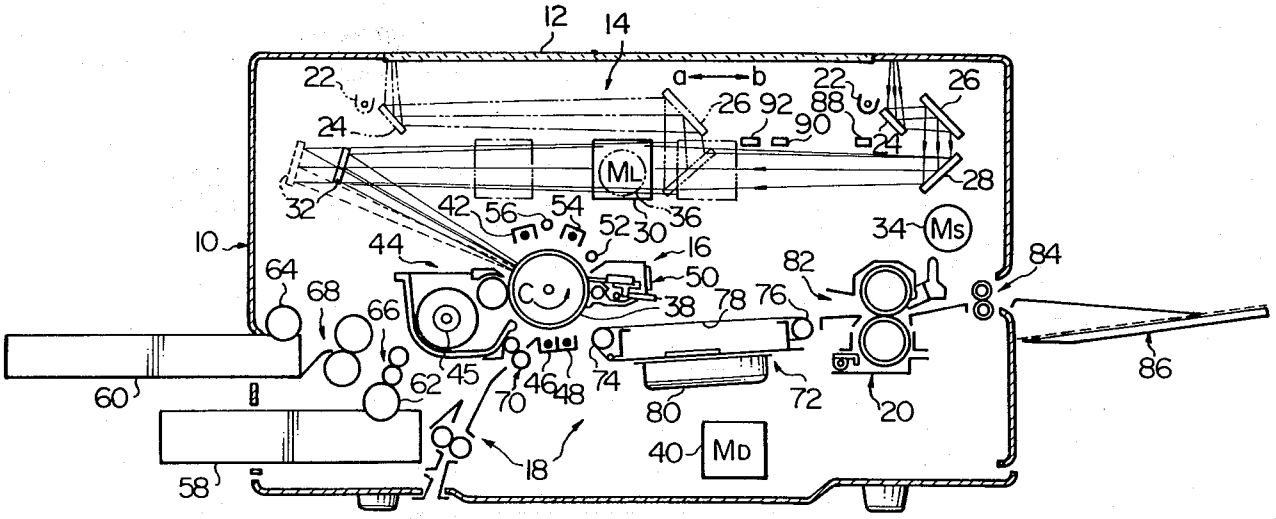
FIG. 1 is a side elevation view showing the general mechanical construction and arrangement of a preferred embodiment of an automated image duplicating apparatus according to the present invention.

As shown in FIG. 1, an image duplicating apparatus embodying the present invention comprises a housing 10 having an upper panel portion which is in part provided by a transparent document table 12. A sheet of document bearing images to be reproduced is to be placed on this document table 12.

The apparatus further comprises an optical scanning system 14, an image reproducing system 16, a paper feed mechanism 18 and an image fixing assembly 20. The optical scanning system 14 comprises a light exposure lamp 22 from which a beam of light is incident on and reflected from the lower face of the document sheet on the document table 12. The reflected light is directed downwardly onto an object mirror 24 and is re-directed rearwardly. The lamp 22 and object mirror 24 are movable together along the document table 12 as indicated by arrows a and b.

The light reflected by the object mirror 24 is re-directed toward a mirror 26, which further re-directs the light downwardly toward another mirror 28. The mirrors 26 and 28 are also movable along the document table 12 into and out of predetermined home positions indicated by full lines. From the mirror 28, the light travels forwardly along the document table 12 and is passed through an image magnification/reduction lens unit 30 (hereinafter referred to as magnification lens unit) to a projecting mirror 32. The lens unit 30 is movable along the document table 12 independently of the exposure lamp 22 and mirrors 24, 26 and 28 with respect to the table 12. Movement of the lens unit 30 in either direction with respect to the mirror 32 results in a change in the ratio of magnification or reduction (hereinafter referred to simply as magnification) of the images to be reproduced. The lamp 22 and mirror 24 are operatively coupled to common drive means and travel at a speed doubling the speed of movement of the mirrors 26 and 28. Such drive means is assumed to include a d.c. scanner drive motor 34 ($M_S$). The lens unit 30 is also operatively coupled to appropriate drive means, which is assumed to include a pulse-driven stepper motor 36 and will be referred to as lens drive motor ($M_L$). It is herein further assumed that the lamp 22 and object mirror 24 implement, in combination, a document scanner 22/24 in the scanning system 14. The document scanner 22/24 has, with respect to the document table 12, a predetermined home position which corresponds to one end of the table 12.

The image reproducing system 16 comprises a cylindrical image transfer drum 38 having a conductive peripheral surface layer coated with a photoconductive substance. The light incident on the image reproducing system 16 is re-directed toward this image transfer drum 38 and is focused onto the peripheral surface of the drum 38. The image transfer drum 38 is driven for rotation in a direction indicated by arrow c by appropriate drive means, which is assumed to include a main drive motor 40 ($M_D$). The lamp 22 and mirror 24 and the mirrors 26 and 28 are driven for movement at speeds proportional to the peripheral speed (V) of rotation of the image transfer drum 38. On the other hand, a change in the position of the lens unit 30 with respect to the peripheral surface of the image transfer drum 38 results in a change in the magnification ratio (N) of the images to be reproduced. In the embodiment herein shown, it is assumed that the lamp 22 and mirror 24 are driven for movement at a speed V/N and the mirrors 26 and 28 at a speed V/2N.

The image reproducing system 16 further comprises a main charger 42 to sensitize the photoconductive peripheral surface of the image transfer drum 38 by applying electrostatic charges uniformly to the surface of the drum 38. These charges are dissipated in areas exposed to light and electrostatic latent images are created by the charges remaining on the drum 38 upon irradiation with light from the mirror 32. Posterior to the path of light to the drum 38 is located an image developing unit 44 having a stock of toner particles to be applied to the photoconductive peripheral surface of the image transfer drum 38. Visible toner images are thus produced conformingly to the latent images on the drum 38. The image developing unit 44 has a developer motor 45 incorporated therein.

Posterior to the image developing unit 44 in turn is provided an image transfer charger 46 which is operative to charge the copy sheet so that the toner images on the image transfer drum 38 are transferred to the copy sheet. The copy sheet thus having the toner images carried thereon is cleared of charges by a separation charger 48 located posterior to the image transfer charger 46. There is further provided a drum cleaner unit 50 which removes any residual toner particles from the peripheral surface of the drum 38. Posterior to this cleaner unit 50 in turn is positioned a charge eraser lamp 52 which irradiates the cleaned peripheral surface of the drum 38 to eliminate the charges which may be left thereon. Indicated at 54 and 56 are an auxiliary charger and an auxiliary charge eraser lamp, respectively. Though not shown, each of the chargers 42, 46, 48 and 54, developing and cleaner units 44 and 50 and eraser lamps 52 and 56 includes or is associated with appropriate drive or actuator means.

The paper feed mechanism 18 is provided in conjunction with lower and upper paper supply cassettes 58 and 60 which are detachably fitted to the housing 10 and which have stocks of copy sheets of different sizes encased therein. The paper feed mechanism 18 per se comprises lower and upper paper feed rollers 62 and 64 each of which is driven for rotation to pick up copy sheets one after another from the stack of paper in the cassette 58 or 60. The copy sheet picked up by the lower paper feed roller 62 is guided directly toward the image transfer drum 38. The feed roller 62 is held in rollable contact with one of a pair of guide rollers 66 which are held in rollable contact with each other. In association with the upper paper supply cassette 60 is provided a pair of guide rollers 68 which are held in rollable contact with each other and which are located between the upper paper feed roller 64 and the pair of guide rollers 66. A copy sheet picked up by the upper paper feed roller 64 is first passed between the guide rollers 68 and subsequently between the guide rollers 66 and is thereafter directed toward the image transfer drum 38.

Each of the paper feed rollers 62 and 64 is operatively connected to the main drive motor 40 through suitable actuator means such as a solenoid-operated clutch (not shown). Posterior to the developing unit 44 is provided a pair of timing rollers 70 which are held in rollable contact with each other. A copy sheet passed from the lower paper feed roller 62 or through the guide rollers 66 is passed to the timing rollers 70. The timing rollers 70 are to be driven for rotation at a timing synchronized with the movement of the document scanner 22/24. The rollers 62 to 70 include drive rollers each of which is driven for rotation from the main motor 40. Each of the paper feed rollers 62 and 64 and one of the timing rollers 70 is operatively connected to the main drive motor 40 through a solenoid-operated clutch (not shown).

The paper feed mechanism 18 further comprises a copy-sheet transport belt assembly 72 positioned posterior to the area where the copy sheet is to be separated from the image transfer drum 38. The transport belt assembly 72 comprises spaced driven and idler rollers 74 and 76 and an endless transport belt 78 passed between the rollers 74 and 76. The transport belt 78 may be formed with perforations for use in combination with any suction generator unit 80. The suction induced by such a unit 80 acts, through the perforations in the belt 78, on the copy sheet being transported on the belt 78 and retains the copy sheet to the belt 78 until the copy sheet is released from the belt 78.

The image fixing assembly 20 is provided at the rear of the transport belt assembly 72 and comprises a pair of heater rollers 82 arranged to form therebetween a nip aligned with the path of travel of a copy sheet from the belt assembly 72. The copy sheet transported on the transport belt 78 is thus nipped between the heater rollers 82 so that the toner particles carried on the sheet are thermally fused and the toner images are fixed on the copy sheet. The copy sheet released from the rollers 82 is withdrawn to a paper collect tray 86 through a pair of paper discharge rollers 84 located posterior to the heater rollers 82 and a paper discharge slot provided in the rear panel portion of the housing 10.

Various sensors and detectors are provided which include a home position sensor 88 and a scan timing sensor 90 located in association with, for example, the exposure lamp 22. The home position sensor 88 produces a home position signal of a logic "1" bit in the presence of the document scanner 22/24 in the home position thereof while the scan timing sensor 90 produces a signal as the scanner 22/24 is driven for movement over a predetermined distance from its home position with respect to the document table 12. Also provided is a sensor 92 for detecting the position of the lens unit 30 with respect to the image transfer drum 38. The sensor 92 implements means for detecting the magnification ratio which is variable with the movement of the lens unit 38 with respect to the drum 38.

Figure 2:
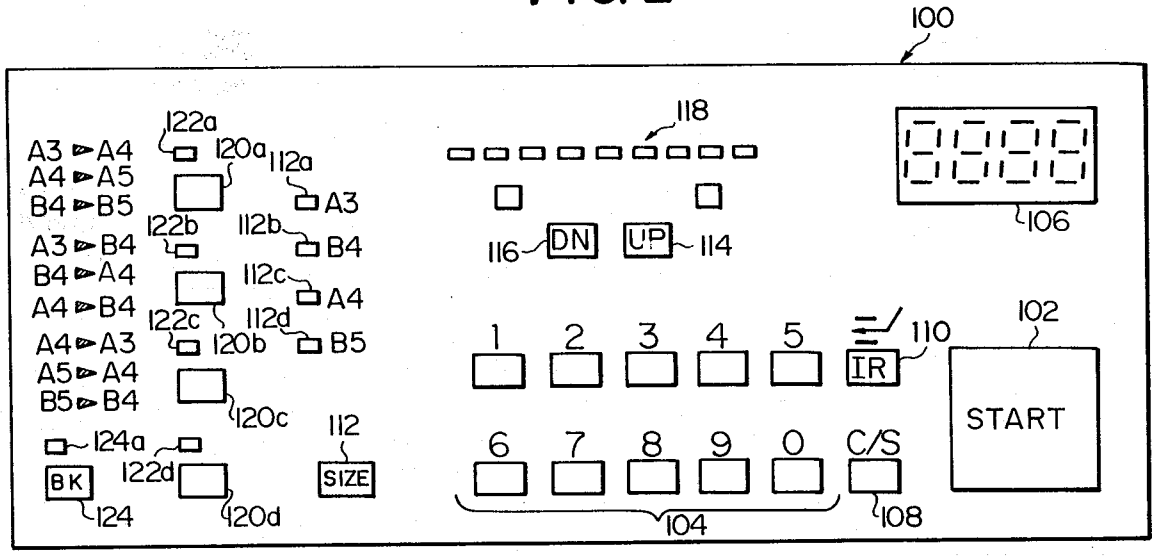
FIG. 2 is a plan view schematically showing the general configuration of a control panel forming part of the image duplicating apparatus illustrated in FIG. 1.

FIG. 2 shows the general configuration of a control panel 100 which forms part of the apparatus embodying the present invention. The control panel 100 comprises a print start switch 102 (START) to start duplicating operation and a set of numerical switches 104 allocated to numerals 1, 2, . . . and 0, respectively. A selected quantity of copy sheets to be printed is displayed on a seven-segment display window 106 and can be cleared from a clear/stop switch 108 (C/S) which may be used also for cancelling the instruction once entered from the print start switch 102. During printing of a preset quantity of copy sheets for a given document sheet, another document sheet may be duplicated in an interrupt mode entered at an interrupt request switch 110 (IR).

The size of copy sheets to be used can be selected at a manual paper-size select switch 112 (SIZE) from among a predetermined number of sizes available. The selected size of copy sheets is displayed by any of paper-size indicators 112*a* to 112*d* which are assumed to be assigned to the standard A3, B4, A4 and B5 sizes, respectively, as shown. The paper-size select switch 112 is, in effect, operative to select one of the paper supply cassettes 58 and 60 currently assembled to the apparatus shown in FIG. 1. Further provided are print density increment and decrement switches 114 and 116 to permit manual selection of a desired print density for the copy sheets to be printed. The print density is stepwise incremented with the switch 114 depressed or decremented with the switch 116 depressed. A series of print density display indicators 118 are activated to illuminate successively in one direction with the increment switch 114 kept depressed and in the other direction with the decrement switch 116 kept depressed. In the control panel 100 are further provided a set of magnification ratio select switches 120*a* to 120*d* and respectively associated indicators 122*a* to 122*d*. The switches 120*a* to 120*d* are assumed to be used for the selection of first-ratio reduced copying, second-ratio reduced copying, magnified copying and one-to-one ratio copying modes, respectively. With one of the switches 120*a* to 120*d* depressed, the associated one of the indicators 122*a* to 122*d* illuminates to indicate the selected ratio of magnification.

In the control panel 100 is further provided a switch 124 (BK) to select a divisional copying mode in which the document sheet to be duplicated consists of opposite two pages spread out of a book or of any other form of bound volume of image bearing pages. Such two pages of a bound volume of image-bearing pages will be herein referred to as "halved document area". Once the switch 124 is depressed for the copying of a document with a halved document area, an associated indicator 124*a* is activated to illuminate until the switch 124 is depressed for a second time thereafter.

Figure 3A:
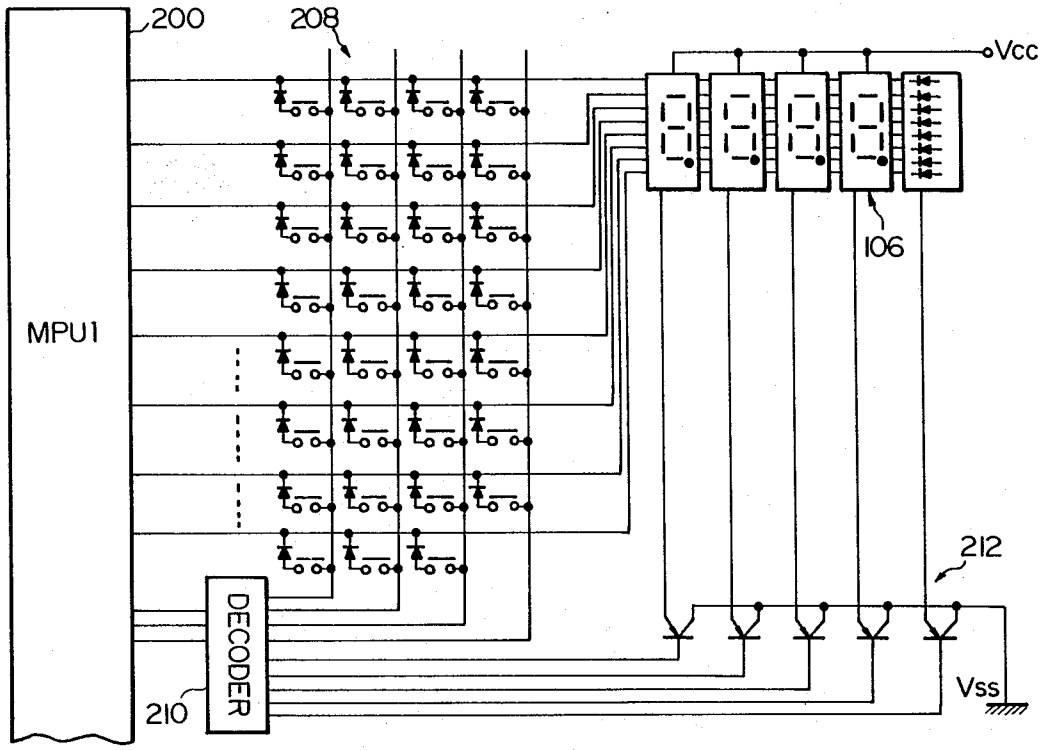
FIGS. 3A and 3B are diagrams schematically showing the general arrangement of a control circuit which may be incorporated in the image duplicating apparatus shown in FIG. 1.
Figure 3B:
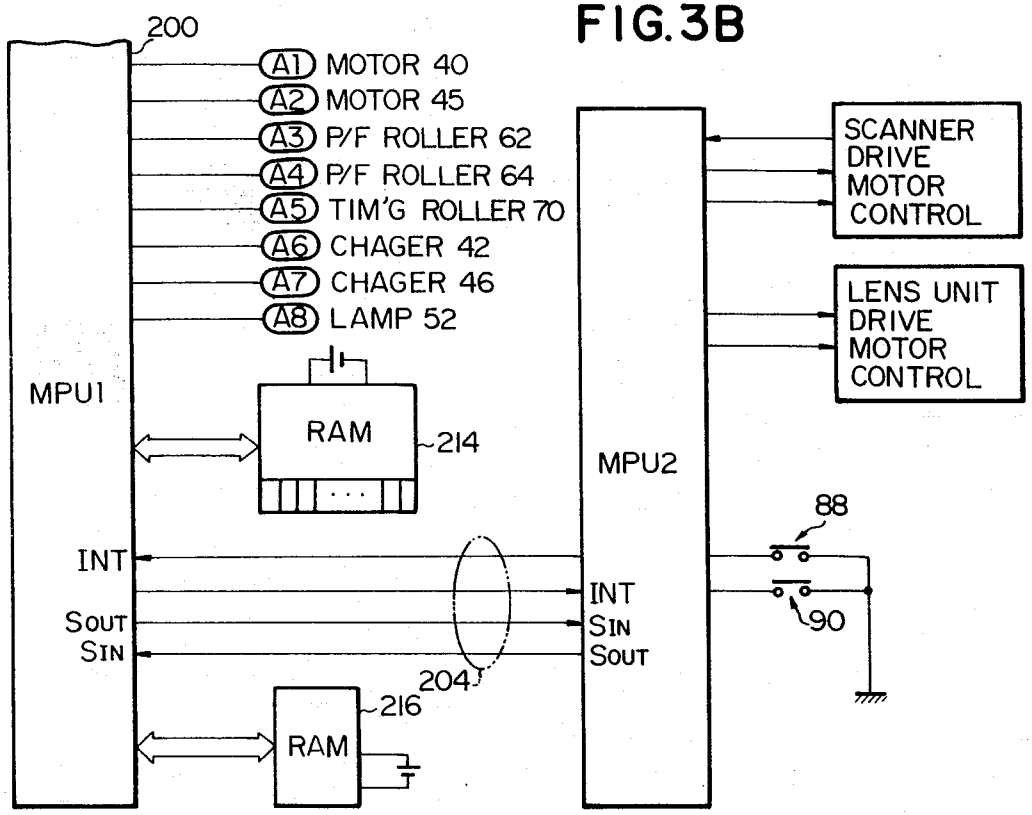

FIGS. 3A and 3B show the general arrangement of a control circuit which may be used to achieve the functions described with reference to FIG. 2. The control circuit comprises first and second microprocessors 200 and 202 (MPU1 and MPU2) which have interrupt (INT) and data input and output ($S_{IN}$, $S_{OUT}$) ports connected together through bus lines 204. The first microprocessor 200 is operative to control the operation of the image reproducing system 16 and paper feed mechanism 18 while the second microprocessor 202 is predominant over the operation of the optical scanning system 14.

The first microprocessor 200 has input terminals connected to a matrix circuit 208 composed of various switch elements including those on the control panel 100 and segment electrodes of the display window 106 on the control panel 100. The microprocessor 200 further has output terminals including those connected through an address decoder 210 to the matrix circuit 208 and to switch elements 212 for the display window 106. The microprocessor 200 further has terminals A1 to A8 connected to switch and actuator elements of the driver circuits for the various electrically driven units. These units include the main and developer drive motors 40 and 45, the clutches for the paper feed and timing rollers 62, 64 and 70, the chargers 42, 46, 48 and 54 and eraser lamps 52 and 56. The first microprocessor 100 is further connected to random-access memory (RAM) circuits 114 and 116 into which the programs dictating various copying modes and conditions may be stored.

The second microprocessor 202 has input terminals connected to the home position and scan timing sensors 88 and 90 provided in association with the optical scanning system 14 and is operative to control the driver circuits for the scanner drive motor 34 and the stepper motor 36 for the magnification lens unit 30. The microprocessor 202 is thus responsive to signals from the home position and scan timing sensors 88 and 90 to regulate the operation of the motors 34 and 36 of the optical scanning system 14 under the control of the first microprocessor 200 through the bus lines 204.

Figure 4:
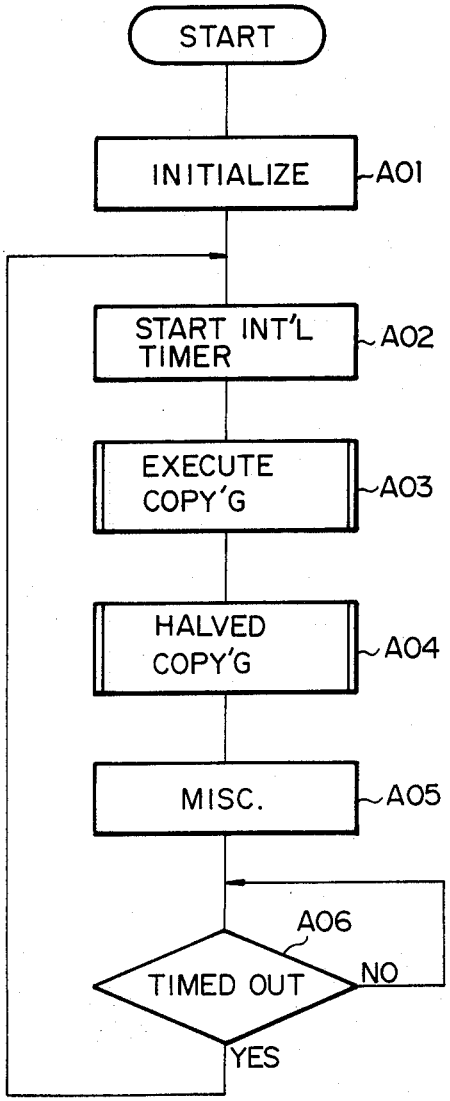
FIG. 4 is a flowchart showing the main routine program to be executed by a first microprocessor included in the control circuit illustrated in FIGS. 3A and 3B.

FIG. 4 shows the main routine program to be executed by the first microprocessor 200. The routine program starts with a step A01 to initialize the various elements of the system including those in the control panel 100 so that copying conditions and modes of operation available in the apparatus are selected in accordance with prescribed "default" rules. An internal timer of the system is then initiated at a step A02 to count the time interval predetermined for a single complete iteration through the routine program. The system now executes a duplication execute subroutine program A03 under optionally selected or default rule conditions. The duplication execute subroutine program A03 may be followed by a divisional copying subroutine A04 if the switch 124 on the control panel 100 has been depressed and turned on. In the main routine program for the microprocessor 200 is further included a subroutine program A05 predominant over some other miscellaneous requirements of the apparatus. Such requirements may include the transfer of data and control signals between the first and second microprocessors 200 and 202 and actuation of the various indicators and display window on the control panel 100. Upon lapse of the predetermined time interval as detected at a step A06 after the internal timer of the system has been initiated, the system reverts from step A05 to the step A02 so that the internal timer of the system is initiated.

Description will now be made in regard to the details of the subroutine programs A03 and A04 thus included in the main routine program of the first microprocessor 200. In the description to follow, it is assumed that the document sheet currently placed on the document table 12 may have a halved document area consisting of opposite two pages spread out of a book or of any bound volume of image-bearing pages. These two pages will be referred to as half sections "Aυ and "B" of the halved document area. It is further assumed that the half section "B" is to be printed prior to the half section "A".

Figure 5A:
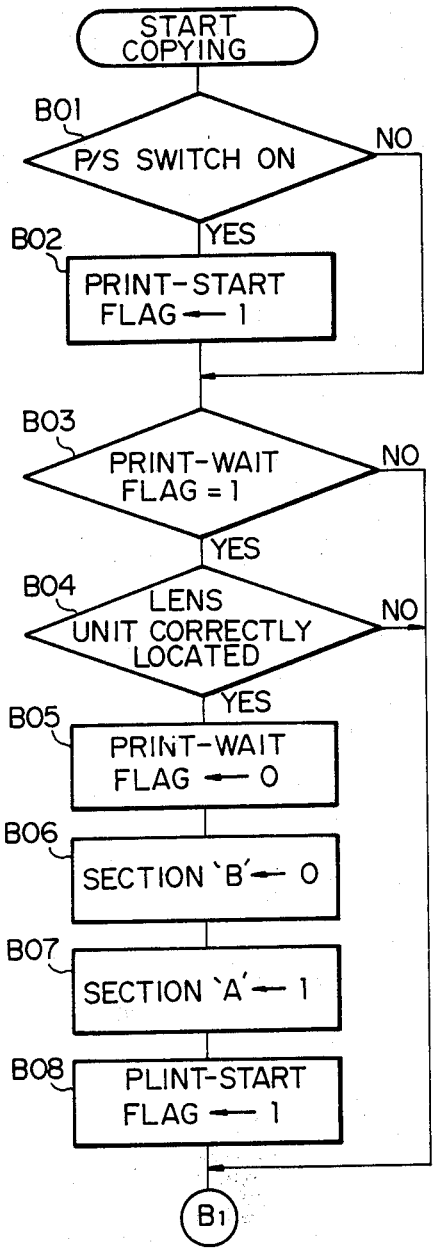
FIGS. 5A to 5E are flowcharts of a duplication execute subroutine program included in the main routine program illustrated in FIG. 4.

Referring to FIG. 5A, the duplication execute subroutine program A03 starts with a decision step B01 to determine whether or not there is a signal produced with the print start switch 102 depressed. If it is found at this step B01 that this is the case, a print-start flag of a logic "1" bit is set at a step B02 to indicate that a copying operation may be started. Subsequently to this step B02 or if it is found at the step B01 that there is no signal produced with the print start switch 102 depressed, it is further questioned at a decision step B03 whether or not there is a print-wait flag of a logic "1" bit. If it is found at this step B03 that there is present a logic "1" print-wait flag bit, then it is tested at a step B04 whether or not the lens unit 30 has been moved to a default-rule position or a position designated from any of the select switches **120*a* to 120*d*. If it is found at this step B04 that the lens unit 30 has reached such a position, then the print-wait flag is shifted to a logic "0" bit as at a step B05 and, thereupon, half section "B" and "A" copy instruction signals of logic "0" and "1" bits, respectively, are set at steps B06 and B07. These instruction signals will be hereinafter referred to as "A" and "B" section copy signals, respectively. Thereupon, the print-start flag is shifted to a logic "1" at a subsequent step B08**.

The series of steps B03 to B08 are to be followed so that the half section "A" of a halved document area of a book or the like is to be copied when the magnification ratio used for the copying of the half section "B" has been changed after the copying of the section "B" was complete or is in progress.

Figure 5B:
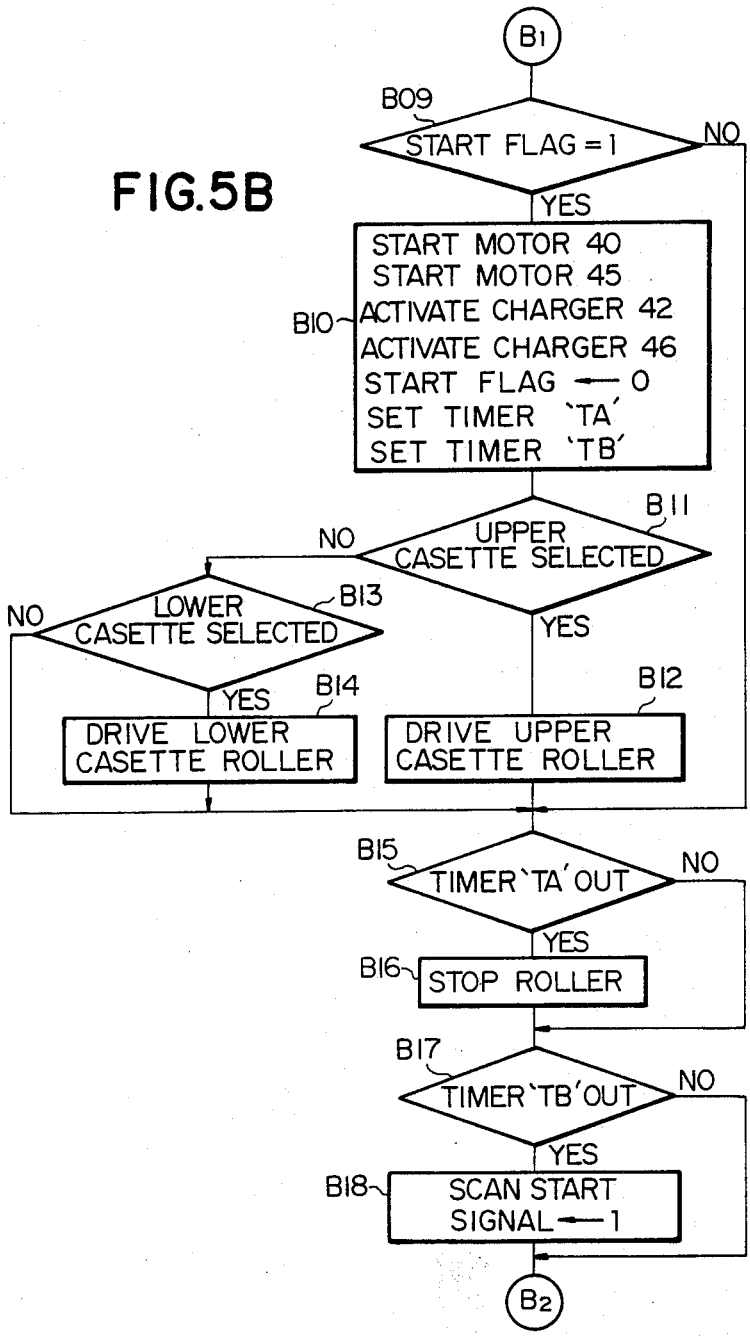

After the print-start flag is shifted to a logic "1" at the step B08 or if it is determined at the step B03 that there is present a logic "0" print-wait flag bit or at the step B04 that the lens unit 30 has not reached the default-rule or any designated position, the subroutine program proceeds through a connector $B_1$ to a decision step B09 shown in FIG. 5B. At this step B09 is questioned whether or not the print-start flag is of a logic "1" bit. If it is found that this is the case, the step B09 is followed by a step B10 at which instruction signals are issued to start the various drive and actuator means included in or associated with the image reproducing system 16. These drive and actuator means may include the main and developer drive motors 40 and 45, and the actuator means for the main and transfer chargers 42 and 46. Also, the print-start flag is shifted to a logic "0" bit and first and second system timers, "TA" and "TB", included in the first microprocessor 200 are enabled to start counting operation. By the first system timer "TA" is prescribed the timing at which the clutch for the paper feed roller 62 or 64 associated with the lower paper or upper supply cassette 58 or 60, respectively, is to be deenergized. By the second system timer "TB" is prescribed the timing at which the document scanner 22/24 is to be initiated into motion to scan the document sheet or book pages on the document table 12.

The step B10 is followed by a decision step B11 at which is questioned whether or not the upper paper supply cassette 6 has been selected. If it is found at the step B11 that this is the case, a signal is issued at a step B12 to actuate the clutch for the paper feed roller 64 associated with the lower paper supply cassette 58. If it is determined at the step B11 that the paper supply cassette 60 has not been selected, it is queried at a decision step B13 whether or not the lower paper supply cassette 58 has been selected. If it is found at this step B21 that this is the case, a signal is issued at a step B14 to actuate the clutch for the paper feed roller 62 associated with the lower paper supply cassette 58.

Subsequently to the step B12 or B14 or if it is found at the step B09 that there is present no print-start flag of a logic "1" bit or at the step B13 that the lower paper supply cassette 58 has not been selected, it is tested at a step B15 whether or not the first system timer "TA" has terminated its counting operation. When the answer for this decision step B15 is given in the affirmative, a signal is issued at a step B16 so that the clutch for the paper feed roller 62 or 64 associated with the selected paper supply cassette 58 or 60 is de-energized. Subsequently to this step B16 or when it is determined at the step B15 that the system timer "TA" is still in operation, it is queried at a step B17 whether or not the time prescribed on the second system timer "TB" has lapsed. If the answer for this step B17 is given in the affirmative, a scan start signal of a logic "1" bit is generated at a step B18 and is supplied to the second microprocessor 202. The second microprocessor 202 is now enabled to issue a signal to initiate the optical scanning system 14 into operation.

Figure 5C:
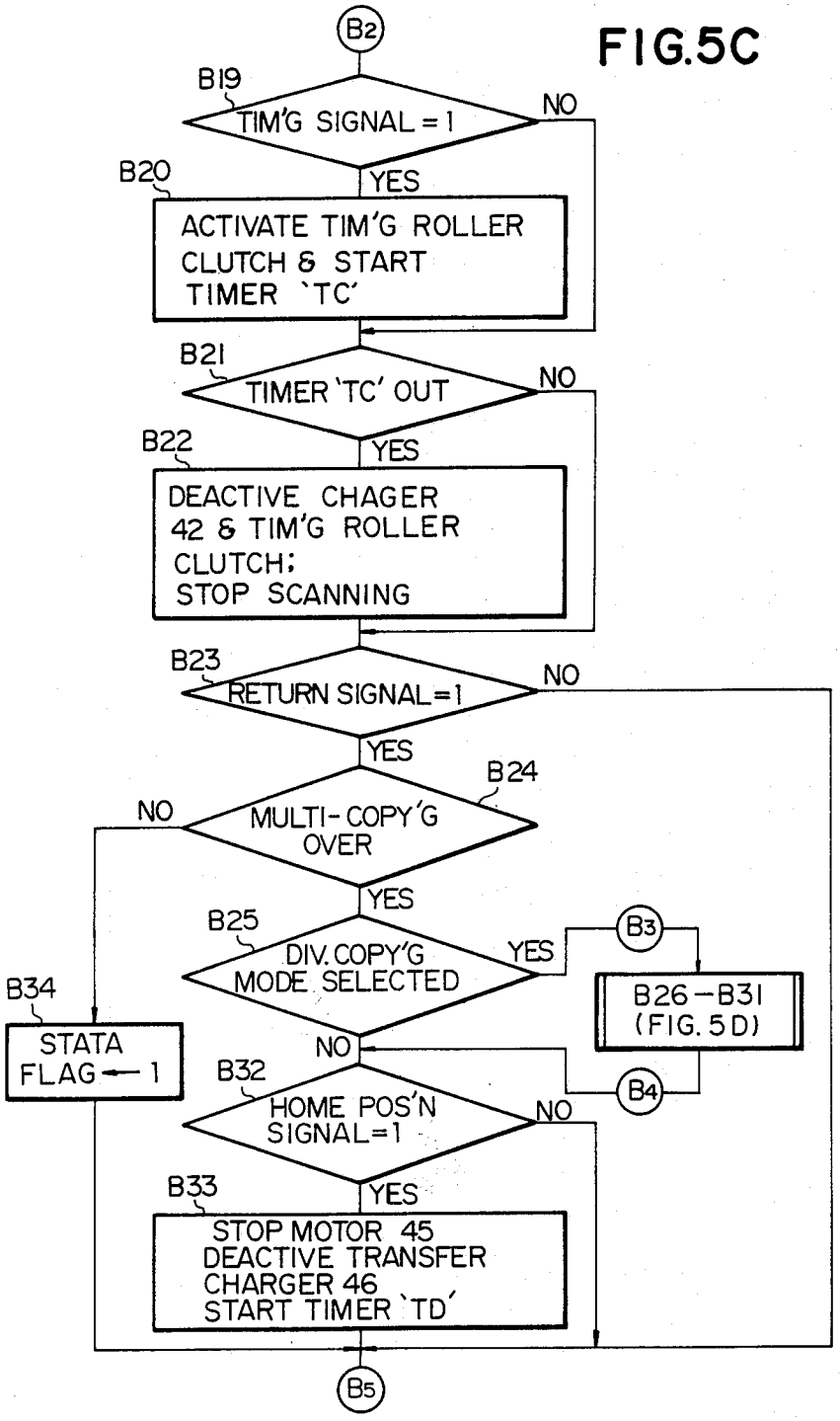

Subsequently to te step B18 or when it is found at the step B17 that the second system timer "TB" is still in operation, the subroutine program proceeds through a connector $B_2$ to a decision step B19 shown in FIG. 5C to query whether or not there is present a timing signal of a logic "1" bit. This timing signal is supplied from the second microprocessor 202 responsive to the signals from the home position and scan timing sensors 88 and 90. When it is determined at the step B19 that there is present the timing signal of logic "1" bit, then a signal is issued at a step B20 to energize the clutch for the timing rollers 70. A copy sheet transported either from the paper supply cassette 58 or 60 is now allowed to pass between the timing rollers 70 into contact with the image transfer drum 38. The toner particles which have been applied to the peripheral surface of the drum 38 are thus transferred to the surface of the copy sheet by means of the image transfer charger 46. At the step B20 is further started a third system timer, "TC", which dictates the timing a which the scanning operation is to be terminated, the timings at which the actuators for the chargers 42, 46 and 48 are to be de-energized, and the timing at which the clutch for the timing rollers 70 is to be de-energized. It is then tested at a decision step B21 whether or not the timings prescribed by the system timer "TC" have been reached. If the answer for this step B21 is given in the affirmative, signals are issued at a step B22 so that the scanning operation is terminated with a scanning signal shifted to a logic "0" bit and the actuator for the main charger 42 and the clutch for the timing rollers 70 are de-energized.

Subsequently to the step B22 or when it is determined at the step B21 that the timings dictated by the system timer "TC" are not still reached, the subroutine program proceeds to a decision step B23 to query whether or not there currently is a scanner return signal of a logic "1" bit supplied from the second microprocessor 202. If the document scanner 22/24 is returning toward its home position so that the scanner return signal is of a logic "1" bit, it is further tested at a decision step B24 whether or not copying operation has been repeated a designated number of times. If it is found at the step B24 that this is the case, then it is questioned at a subsequent decision step B25 whether or not the divisional copying mode of operation has been selected with the switch 124 depressed. If the answer for this step B25 is given in the affirmative, the subroutine program proceeds through a connector $B_3$ to a divisional copying subroutine program B26–B31 shown in FIG. 5D.

Figure 5D:
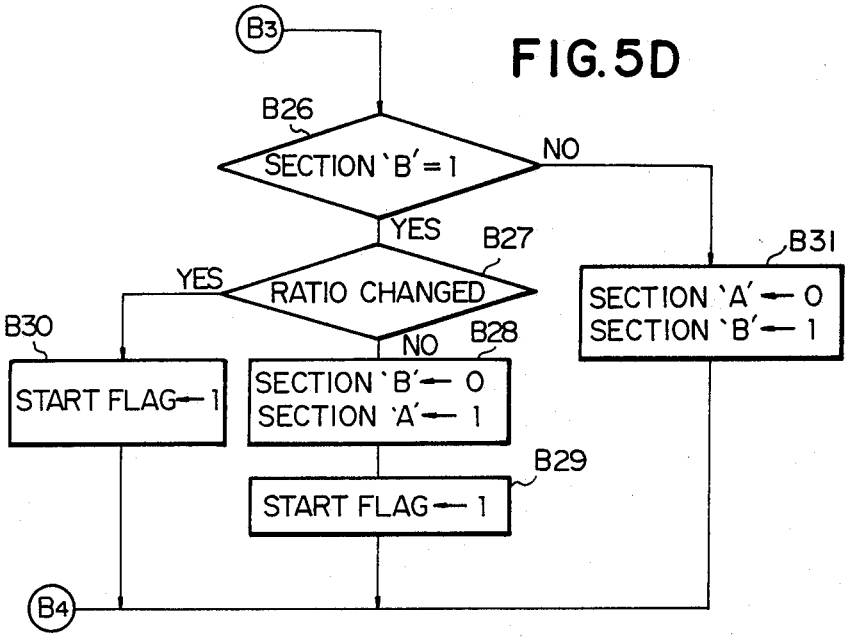

In the subroutine program shown in FIG. 5D, it is first tested at a step B26 whether or not the "B" section copy signal is of a logic "1" bit. In the presence of such a signal, it is further tested at a decision step B27 whether or not there is a signal requesting a new magnification ratio with any one of the switches **120*a* to 120*d* depressed for the half section "B" of the halved document area. If the answer for this step B27 is given in the affirmative, the "B" and "A" section copy signals of logic "0" and "1" bits, respectively, are set at a step B28 and thereafter the print-start flag is shifted to a logic "1" bit at a step B29. If it is found at the step B27 that there is a signal calling for a new magnification ratio for the half section "B", the print-wait flag is shifted to a logic "1" bit at a step B30. If it is found at the preceding step B26 that the "B" section copy signal is of a logic "0" bit, "A" and "B" section copy signals of logic "0" and "1" bits, respectively, are set at a step B31. Subsequently to any of the process steps B29, B30 and B31, the system proceeds through a connector $B_4$ to a decision step B32 shown in FIG. 5C**.

Figure 5E:
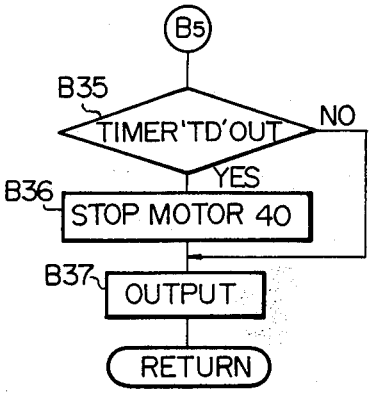

The decision step B32 is also followed if it is found at the previous decision step B25 that the divisional copying mode of operation has not been selected and queries whether or not the document scanner 22/24 has reached its initial home position. This test is also made on the basis of a signal of a logic "1" bit supplied from the second microprocessor 202. If the answer for the step B32 is given in the affirmative, a signal is issued at a step B33 so that the drive motor in the developing unit 44 and the actuator for the image transfer charger 46 are de-energized. At the step B33 is further started a fourth system timer, "TD", which dictates the timing at which the main drive motor 40 is to be brought to a stop. If it is found at the previous step B24 that the copying operation to be repeated a designated number of times is still in progress, a signal is issued at a step B34 to raise the print-start flag of a logic "1" bit for a second time. Subsequently to the step B33 or B34 or if it is determined at the step B32 that the document scanner 22/24 has not yet reached its initial home position, the subroutine program proceeds through a connector $B_5$ to a decision step B35 shown in FIG. 5E. Upon lapse of the time set by the fourth system timer "TD", a signal is issued at a step B36 to de-energize the main drive motor 40. The step B36 is followed by a step B37 at which appropriate control signals may be supplied to any external devices. Upon completion of the process step B37, the subroutine program recycles to the initial step B01 shown in FIG. 5A.

Figure 6:
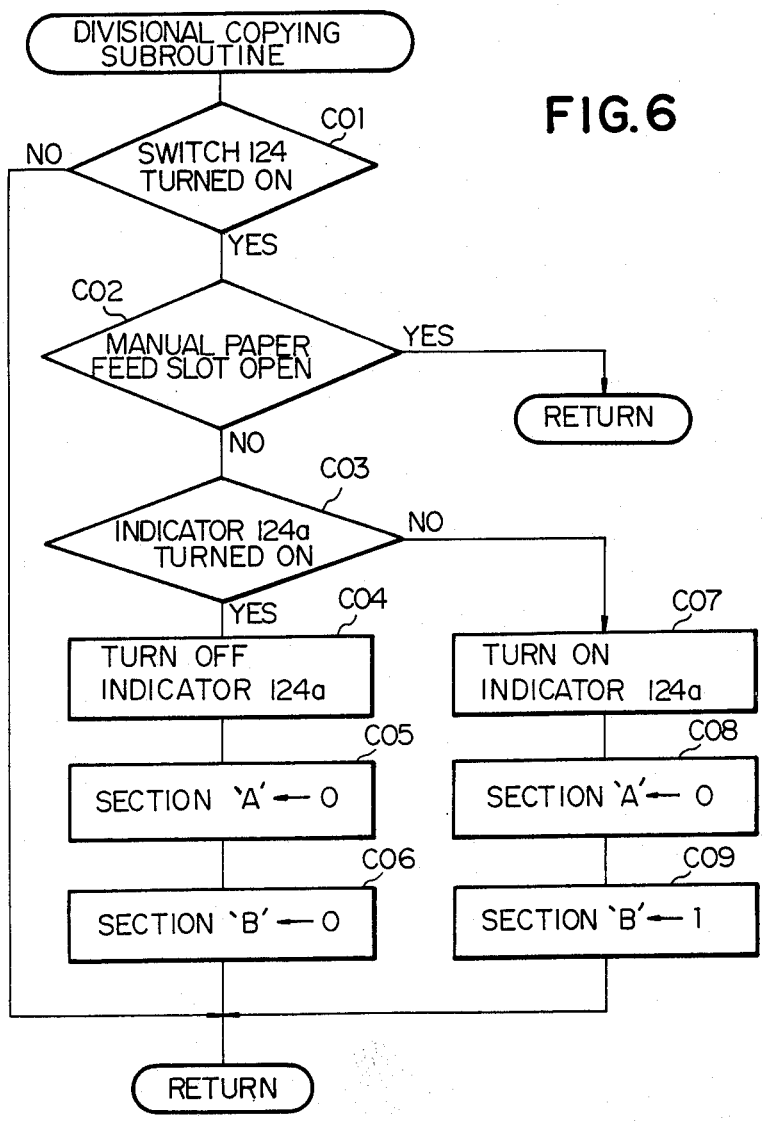
FIG. 6 is a flowchart showing an example of the subroutine program to be executed by the first microprocessor when a divisional copying mode of operation is selected.

FIG. 6 is a flowchart showing the subroutine program to be executed by the first microprocessor 200 to supply the "A" and "B" section copy signals each of logic "1" or "0" to the second microprocessor 202. For this purpose, it is first confirmed at a step C01 that the divisional copying mode is currently selected with the switch 124 depressed and thereafter at a step C02 that the manual paper feed slot provided in the apparatus shown in FIG. 1 is not currently open.

Subsequently to the step C02, it is tested at another decision step C03 whether or not the indicator **124*a* associated with the divisional copying mode select switch 124 is turned on. If it is found at the step C03 that the indicator 124*a* is turned on, a signal is issued to turn off the indicator 124*a* at a step C04 and thereafter the "A" and "B" section copy signals each of a logic "0" bit are supplied to the second microprocessor 202 at steps C05 and C06, respectively. If it is found at the step C03 that the indicator 124*a* is turned off, a signal is issued to turn on the indicator 124*a* at a step C07 and thereafter the "A" and "B" section copy signals of logic "0" and "1" bits are supplied to the second microprocessor 202 at steps C08 and C09, respectively. Thus, the divisional copying mode of operation and the ordinary mode of copying operation are set up alternately each time the switch 124 is depressed with the manual paper feed slot closed. When the divisional copying mode of operation is established, the second microprocessor 202** receives the "B" section copy signal of the logic "1" bit to start the former half of a cycle of divisional copying operation for the half section "B" of the halved document area.

Figure 7A:
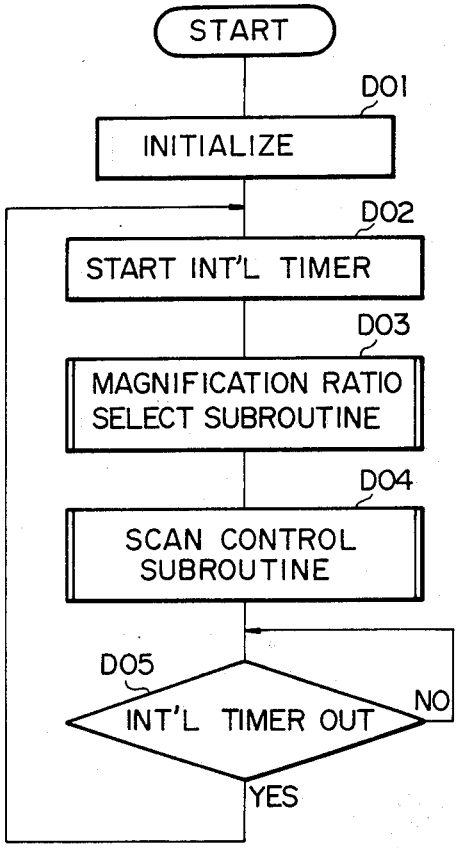
FIG. 7A is a flowchart showing an example of the routine program to be executed by a second microprocessor included in the control circuit illustrated in FIGS. 3A and 3B.

FIG. 7A is a flowchart showing a preferred example of the main routine program to be executed by the second microprocessor 202. The routine program starts with a step D01 at which the optical scanning system 14 is initialized and thereafter a predetermined period of time is set by an internal timer of the microprocessor 202 as at a step D02. The step D02 is followed by a subroutine D03 by which the ratio of magnification for copying may be changed by the default rule or from any of the switches 120*a* to 120*b*. Subsequently to the subroutine D03, a scan control subroutine B04 is executed so that the document sheet placed on the document table 12 is scanned by the document scanner 22/24. When it is found at a step D05 that the period of time set at the step D02 has lapsed, the routine program recycles to the step D02.

Figure 7B:
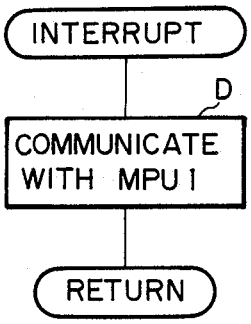
FIG. 7B is a flowchart showing an example of the interrupt control routine program in accordance with which the second microprocessor may be interrupted.

The second microprocessor 202 may be interrupted in accordance with the interrupt control routine program shown in FIG. 7B. When there is a request for interrupt from the first microprocessor 200, the second microprocessor 202 communicates with the first microprocessor 200 at a step D. The second microprocessor 202 is thus enabled to execute the magnification ratio change subroutine D03 and scan control subroutine D04 in response to instruction signals issued from the first microprocessor 200.

Figure 8:
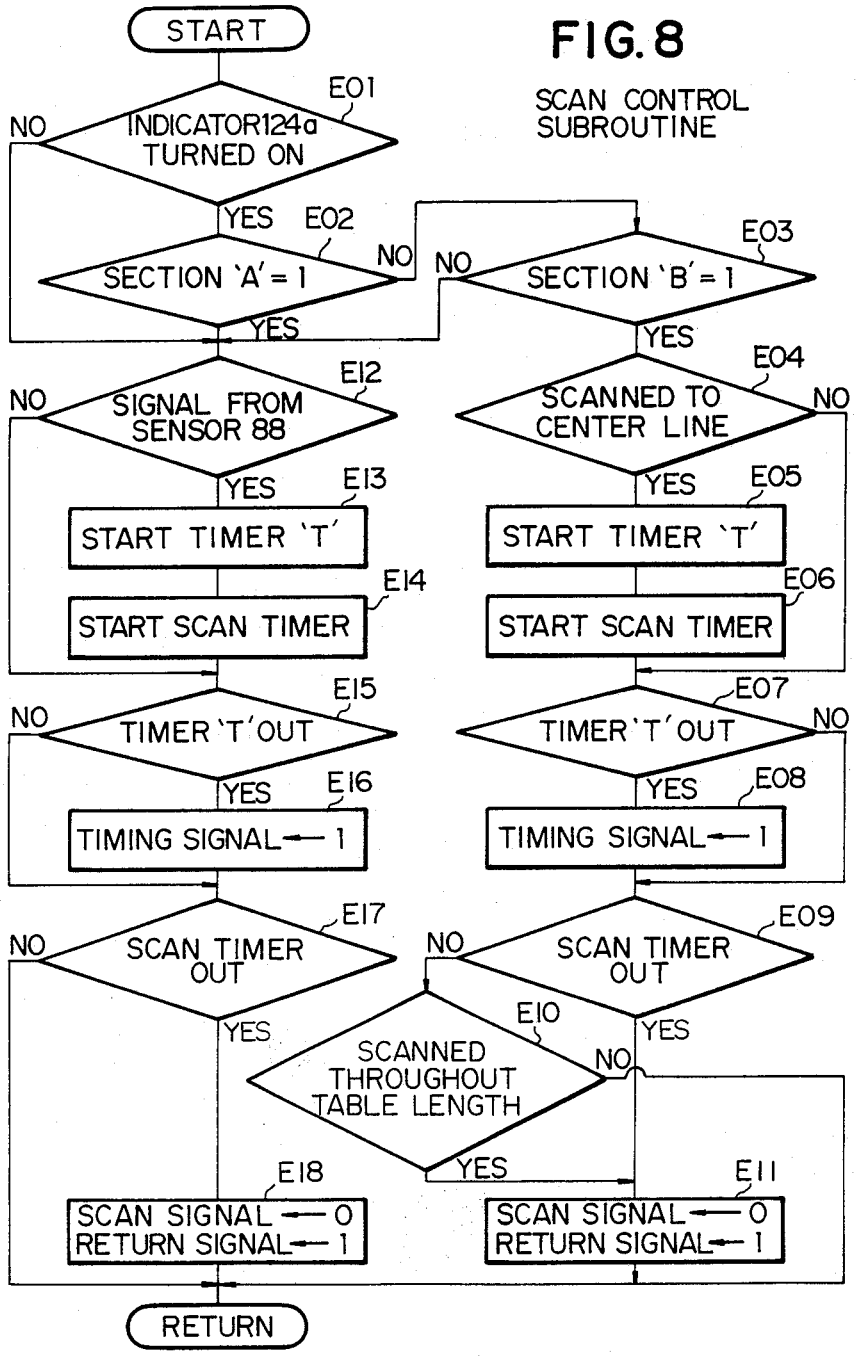
FIG. 8 is a flowchart showing the details of the scan control subroutine program included in the routine program illustrated in FIG. 7A.

FIG. 8 shows the details of the scan control subroutine program D04 included in the routine program illustrated in FIG. 7A. The subroutine program D04 starts with a decision step E01 at which it is questioned whether or not a divisional copying mode indicator 124*a* is currently turned on with the associated switch 124 depressed. If it is determined at the step E01 that this is the case, it is assumed that there is a book placed on the document table 12 with any opposite two of its pages spread open on the table 12. In this instance, it is questioned at another decision step E02 whether or not the "A" section copy signal received from the first microprocessor 200 is of a logic "1" bit demanding the scanning of the former half, or page, of the halved document area. If the answer for the step E02 is given in the negative, it is further tested at a decision step E03 whether or not the "B" section copy signal also received from the first microprocessor 200 is of a logic "1" bit demanding the scanning of the latter half or page of the halved document area. If it is found at the step E03 that the "B" section copy signal is of a logic "1" bit, it is further tested at a decision step E04 whether or not the halved document area occupied by the two pages spread open on the document table 12 has been scanned to a line bisecting the whole area of the table 12. If it is found at the step E04 that the halved document area has been scanned to such a line, a timer, "T", which dictates the timing at which a copy sheet is to be supplied from the paper supply cassette 58 or 60 is started at a step E05. Such a timing is determined on the basis of the speed at which the document scanner 22/24 travels forwardly along the table 12. After or simultaneously as the timer "T" is thus started, a timer to dictate the period of time for which the document area is to be scanned is started at a step E06. This period of time is determined on the basis of the length of the selected copy sheet and the selected magnification ratio. When it is thereafter confirmed at a step E07 that the timing set up by the timer "T" is reached, the timing signal at which the clutch for the timing rollers 70 is to be energized is shifted to a logic "1" bit as at a step E08. It is then queried at a decision step E09 whether or not the time set up at the step E06 has lapsed. If it is found that this is the case or it is proved at a step E10 that the whole area of the document table 12 has been completely scanned throughout its length, signals are issued at a step E11 so that the scanning operation is terminated with the scanning signal shifted to a logic "0" bit and the scanner return signal shifted to a logic "1" bit.

If it is determined at the decision step E02 that the "A" section copy signal is of a logic "1" bit, it is further queried at a step E12 whether or not there is present a logic "0" bit signal output from the home position sensor 88. If the answer for the step E12 is given in the affirmative, the timer "T" is started at a step E13. After or simultaneously as the timer "T" is thus started, the timer dictating the scanning period of time is started at a step E14. When it is thereafter confirmed at a step E15 that the timing set up by the timer "T" is reached, the timing signal is shifted to a logic "1" bit as at a step E16. It is then queried at a decision step E17 whether or not the time set up at the step E14 has lapsed. If it is found that this is the case, signals are issued at a step E18 so that the scanning operation is terminated with the scanning signal shifted to a logic "0" bit and the scanner return signal shifted to a logic "1" bit. The subroutine program now recycles to the initial decision step E01.

It will have been understood that the subroutine program E01–E18 is such that the document scanner 22/24 starts to scan the half section "B" of a halved document area after the scanner has scanned a former half of the whole area of the document table 12 in response to the "B" section copy signal of a logic "1" bit. The document scanner 22/24 then returns to its home position and in the presence of the "A" section copy signal of a logic "1" bit further scans the other half section "B" of the halved document area.

Figure 9:
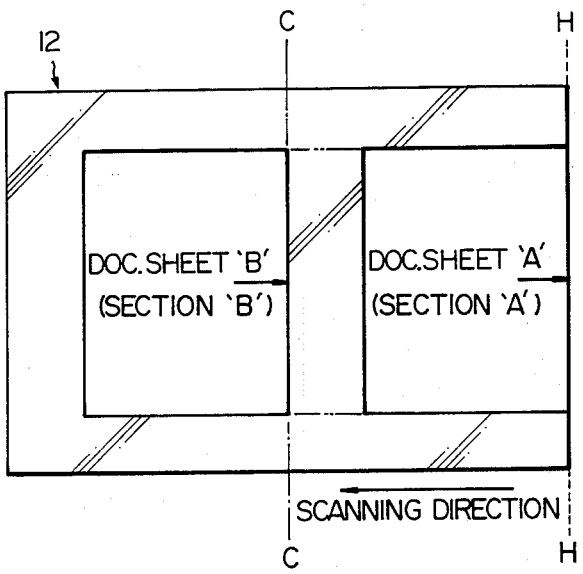
FIG. 9 is a schematic view showing the arrangement in which separate document sheets or any document material providing a halved document area are placed on the document table for divisional copying mode of operation in the apparatus embodying the present invention.

As will have further been understood from the foregoing description, the timing signal of a logic "1" bit is output in synchronism with the speed at which the document scanner 22/24 scans the halved document area so that the respective images on the half sections "B" and "A" of the halved document area are duplicated on separate copy sheets, respectively. The book or any other form of bound volume of image-bearing pages is placed on the document table 12 so that the center line between the half sections "A" and "B" of the halved document area is located along the center line of the document table 12. Where the half sections "A" and "B" of the halved document area are provided by two separate document sheets, the document sheets are to be placed on the table 12 in such a manner that one end of one half section "B" is located along the center line C-C of the document table 12 as indicated in FIG. 9. In this instance, one end of the other half section "A" of the halved document area will be located along the end line H-H of the document table 12 which corresponds to the home position of the document scanner 22/24. Two separate document sheets can be in this manner duplicated by a single copying operation.

If the ratio of magnification is changed for the copying of the half section "A" of the halved copy area after the half section "B" of the copy area has been copied, the copying operation for the half section "A" is started automatically after the lens unit 30 has reached the position to provide the newly selected magnification ratio. Thus, two separate document sheets can be duplicated with different magnification ratios by a single copying operation.

While it has been assumed that the ratio of magnification is stepwise variable through manipulation of the switches 120*a* to 120*d*, the magnification ratio may be made variable continuously with use of, for example, a zoom lens device. Furthermore, it will be apparent that the reference lines for the half sections of a halved document area may not necessarily be those defined by the center and end lines C-C and H-H of the document table 12 but may be defined by any other lines fixed with respect to the document table 12. Where it is desired that the half sections "A" and "B" of a halved document area are copied onto copy sheets identical in size to the half sections "A" and "B", the half sections "A" and "B" may be placed on the document table 12 so that one half section "A" is located with reference to the line H-H of the table 12 and the other half section "B" is located contiguously to the half section "A". In this instance, a movable indicator indicative of the reference line for the division of the document area may be provided in conjunction with the document table 12. Arrangement may be further made so that only a limited region of the halved document area can be duplicated depending on the nature of the document sheet or book placed on the document table 12. In the embodiment of the present invention, not only document sheets having identical sizes but those having different sizes can be duplicated on the opposite surfaces of a single copy sheet or on two sheets of identical sizes through utilization of the individual copying functions with the magnification ratio for copying varied from one document sheet to another.

What is claimed is:

1. An image duplicating apparatus comprising (a) means for supporting a document sheet thereon;

(b) means for dividing an image area of said document sheet into two sections and successively duplicating the respective images on the two sections onto two separate copy surfaces;

(c) means for specifying the ratio by which an image on said document sheet is to be magnified or reduced for copying;

(d) means for altering a currently established magnification or reduction ratio to a newly specified ratio of magnification or reduction; and (e) control means for controlling said duplicating means so that, when the magnification or reduction ratio is altered during duplication of a first one of said two section, a second one of the two sections is copied in the altered magnification or reduction ratio.

2. An image duplicating apparatus as set forth in claim 1, in which said control means comprises means for determining whether or not a new magnification or reduction ratio has been entered during duplication of said first one of said two sections so that, when the detected magnification or reduction ratio is altered to the new one prior to the start of the duplication of said second one of the two sections, the magnification or reduction ratio effective for the duplication of said second one of said two sections is shifted to said new magnification or reduction ratio upon termination of the duplication of said first one of said two sections.

3. An image duplicating apparatus comprising (a) means for supporting a document sheet thereon, (b) means for optically scanning said document sheet and projecting the resultant image onto a photosensitive medium, (c) means for specifying the ratio in which an image on said document sheet is to be magnified or reduced for copying, (d) ratio alteration means operative to alter a currently established magnification or reduction ratio to the specified ratio of magnification or reduction, (e) means for dividing an image area of said document into two sections consisting of first and second sections and successively duplicating the respective images on the first and second sections onto separate first and second copy surfaces, respectively, and (f) control means for controlling said duplicating means so that, when the magnification or reduction ratio is altered during duplication of said first section, said ratio alteration means is initiated into operation to alter the currently established magnification or reduction ratio to said specified ratio of magnification or reduction upon termination of the optical scanning of said first section and prior to the start of the optical scanning of said second section.

4. An image duplicating apparatus having a function to vary the ratio of magnification or reduction for copying and a divisional copying mode of operation for the copying of images on a document area consisting of first and second sections with the image on the first section duplicated on a first surface and the image on the second section duplicated on a second surface distinct from said first surface, comprising (a) means for allowing alteration of the ratio of magnification or reduction for copying during duplication of the image on said first section and generating a signal representative of the altered ratio of magnification or reduction, and (b) means responsive to said signal for altering a currently established magnification or reduction ratio to said altered ratio of magnification or reduction prior to the start of the duplication of the image on said second section and thereafter duplicating the image on said second section.

5. An image duplicating apparatus comprising:

(a) means for supporting a document sheet thereon;

(b) means for dividing an image area of said document sheet into two sections and successively duplicating the images on the two sections onto two separate copy surfaces, respectively;

(c) means for specifying the ratio by which an image on said document sheet is to be magnified or reduced for copying;

(d) means for altering a currently established magnification or reduction ratio to a newly specified ratio of magnification or reduction; and (e) control means for controlling said duplicating means so that, when the magnification or reduction ratio is altered during a period of time intervening between the time when duplication of a first one of said two section is started and the time when duplication of a second one of said two sections is started, the second one of the two sections is copied in the altered magnification or reduction ratio.

* * * * *